US007704113B2

(12) United States Patent
Pele et al.

(10) Patent No.: US 7,704,113 B2
(45) Date of Patent: Apr. 27, 2010

(54) LIFEJACKET

(75) Inventors: Nicolas Pele, Hendaye (FR); Charles Deville, Lyons (FR)

(73) Assignee: Decathlon, Villeneuve D'Ascq. (FR)

( * ) Notice: Subject to any disclaimer, the term of this patent is extended or adjusted under 35 U.S.C. 154(b) by 55 days.

(21) Appl. No.: 11/984,746

(22) Filed: Nov. 21, 2007

(65) Prior Publication Data

US 2008/0139062 A1 Jun. 12, 2008

(30) Foreign Application Priority Data

Nov. 23, 2006 (FR) ..... 06 55075

(51) Int. Cl.

| | |
|---|---|
| ***B63C 9/08*** | (2006.01) |
| *B63C 9/00* | (2006.01) |
| *B63C 9/15* | (2006.01) |
| *B63C 9/125* | (2006.01) |

(52) U.S. Cl. ..... 441/118; 441/80; 441/88; 441/92; 441/106; 441/108

(58) Field of Classification Search ..... 441/80, 441/87, 88, 90, 106, 108, 111–119, 123
See application file for complete search history.

(56) References Cited

U.S. PATENT DOCUMENTS

| | | | | |
|---|---|---|---|---|
| 2,950,188 | A * | 8/1960 | Thurber et al. | 420/1 |
| 3,076,207 | A * | 2/1963 | Manhart | 441/118 |
| 3,681,801 | A | 8/1972 | Bel | |
| RE31,305 | E * | 7/1983 | Moran | 411/123 |
| 4,662,850 | A * | 5/1987 | Bostic, Sr. | 441/123 |
| 4,887,987 | A * | 12/1989 | Kato | 441/96 |
| 5,746,633 | A | 5/1998 | Jeffrey | |
| 2002/0046689 | A1 | 4/2002 | Noonan | |

FOREIGN PATENT DOCUMENTS

| | | | |
|---|---|---|---|
| EP | 0659638 | A1 | 6/1995 |
| EP | 1 067 044 | A1 | 1/2001 |
| GB | 884 243 | A | 12/1961 |
| GB | 942 416 | A | 11/1963 |
| WO | WO 2005/095203 | A1 | 10/2005 |

* cited by examiner

*Primary Examiner*—Daniel V Venne
(74) *Attorney, Agent, or Firm*—Kenyon & Kenyon LLP

(57) ABSTRACT

The invention relates to a lifejacket used in the field of safety equipment aboard a boat. The jacket comprises an inflatable vest having two faces opposite one another, which can be housed, folded, in a protective envelope, which comprises an external peripheral opening fitted with temporary closing means by which the vest can expand when inflated. The jacket also comprises a carrying harness to which the envelope can be fixed. The vest comprises inside at least one non-inflatable zone in which its two faces opposite one another are assembled, especially by thermowelding. Thus, this non-inflatable zone, inside the vest and not on its periphery, allows it to have a hooking zone for correct attaching of the vest, the protective envelope and the harness.

8 Claims, 1 Drawing Sheet

LIFEJACKET

This application claims priority to French Patent Application No. 0655075 filed 23 Nov. 2006, the content of which is incorporated herein by reference.

FIELD OF THE INVENTION

The object of the present invention is a lifejacket. Its application quite naturally is in the domain of safety equipment aboard a boat, especially for sailing, and whereof the aim is to keep the head of the wearer above water.

BACKGROUND OF THE INVENTION

Such a lifejacket generally has an inflatable vest housed in a protective envelope when this vest is not inflated and folded up.

The protective envelope has an external peripheral opening by which the vest can expand when inflated. To allow the folded vest to remain inside the protective envelope, the opening at the external periphery of this protective envelope generally comprises temporary closing means such as closing strips of loop-and-hook type.

The protective envelope can also be fixed on a carrying harness for keeping the ensemble on the body of the wearer.

One of the problems posed by this type of jacket is that the vest is never attached to the protective envelope. In fact, the vest generally comprises loops at its ends, in which the carrying harness slides.

This results in a major disadvantage, especially when the vest is being folded inside the envelope.

Also, the mobility of the wearer is diminished, in particular in the case of a live-aboard yacht, and there are risks of obstructing airways, due to the fact that the ensemble does not sit correctly integrally with the body of the wearer once the vest is inflated.

SUMMARY OF THE INVENTION

The object of the invention is therefore to provide a solution to the abovementioned problems, amongst others.

The invention therefore relates to a lifejacket which comprises an inflatable vest having two faces opposite one another.

In its folded state the inflatable vest can be housed in a protective envelope, which further comprises an external peripheral opening fitted with temporary closing means by which the vest can expand when inflated.

The lifejacket also comprises a carrying harness to which the envelope can be fixed.

The vest characteristically comprises, on its interior, at least one non-inflatable zone, in the form of a non-inflatable frontal strip, in which its two faces opposite one another are assembled, especially by thermowelding.

Moreover, the vest is fixed to the harness according to this non-inflatable frontal strip.

Since this zone non-inflatable is thus located inside the vest, and not at its periphery, and since it takes the form of a frontal strip, this allows the jacket to have a hooking zone for correct attaching of the main elements of the jacket, specifically the vest, the protective envelope and the harness.

In a first variant, the non-inflatable frontal strip is incurved.

In a second variant, optionally in combination with the first, the non-inflatable frontal strip has at least one protuberance on at least part of its length.

This protuberance can be connected to the frontal strip non-inflatable for example by stitching, thermowelding or even adhesion.

In yet another variant, optionally in combination with any one or more of the above, the harness comprises a strap, and the lower part of the non inflatable frontal strip is fixed directly or by means of its protuberances to this strap.

The jacket preferably comprises at least a first section of reinforced belt. This section is connected by stitching to the belt, to the vest, and to the protective envelope, according to the non-inflatable frontal strip directly or by means of its protuberances.

Accordingly, the solidarity between the harness, the envelope, the vest, and the wearer, is reinforced.

The jacket optionally comprises a second section of reinforcing strap, also connected by stitching to the belt, the vest and the protective envelope, according to the non-inflatable frontal strip directly or by means of its protuberances.

The first section and the second section then extend to the rear part of the vest by passing respectively over the two shoulders of the wearer.

The protective envelope preferably comprises a single frontal panel whereof the two side edges above the belt have a concave curve treeing especially the axillary zone.

Therefore, the cutout of the front panel of the protective envelope is designed to optimise the liberty of movement specific to sailing.

In another variant embodiment, optionally in combination with the preceding, the vest comprises two transversal non-inflatable strips, to be arranged above the shoulders of the wearer and suitable for acting as articulations between the front and rear parts of the vest.

These two non-inflatable transversal strips connect, for example by thermowelding, the two faces of the vest opposite one another.

These two transversal strips constitute points of articulation especially beneficial to comfort at the level of the neck when the vest is inflated. Being placed above the shoulders of the wearer allows the jacket to better adapt to the shoulders.

Each non-inflatable transversal strip preferably occupies only part of the width of the vest, so as to allow passage of air between the front and rear parts of the vest.

The distribution and the diffusion of air between the front part and the rear part of the vest are consequently improved.

In yet another variant embodiment, optionally in combination with any one or more of the preceding, the vest has an oblong configuration with a hole offset to the rear for passage of the head.

Other characteristics and advantages of the invention will emerge more clearly and completely from the following description of the preferred variant embodiments of the jacket, which are given by way of none inflatable limiting examples and in reference to the following diagrams.

DETAILED DESCRIPTION

Figure 1:
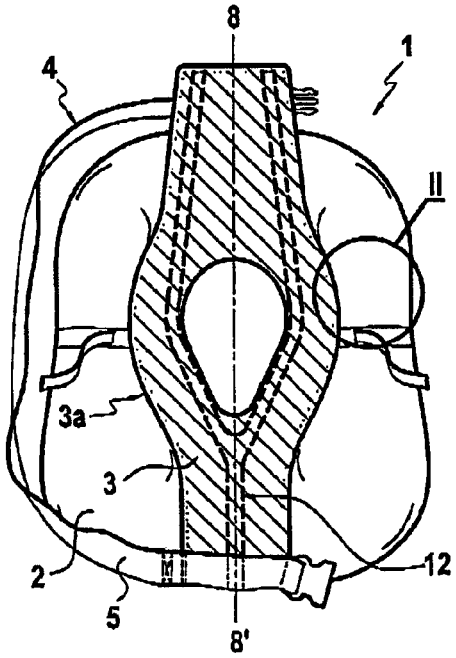
FIG. 1 schematically illustrates the jacket in plan view from above, with the vest inflated, FIG. 2 schematically illustrates a detail of FIG. 1, at the level of the separation between the rear part and the front part of the vest, FIG. 3 schematically illustrates in greater detail the protective envelope of the vest, the latter being inflated, FIG. 4 schematically illustrates the jacket in plan view from below, with the vest deflated and folded inside the envelope.

FIG. 1 schematically illustrates the jacket 1 in plan view from above, with the inflatable vest 2 in the inflated state.

This vest 2 thus inflated escapes from the protective envelope 3 in which is initially housed in the folded and deflated state. More precisely, the vest 2 expands when inflated by an external peripheral opening 3*a* of the protective envelope 3, over the circumference of the latter.

This vest 2 is therefore fitted conventionally with non-inflatable inflating means.

In the folded and deflated state, the vest 2 is kept inside the protective envelope 3 by way of temporary closing means of the external peripheral opening 3*a*. These closing means can be classically closing strip of loop-and-hook type.

A carrying harness 4 completes the jacket 1, preferably fixing the protective envelope 3.

The vest 2 has two faces opposite one another, whereof only one is visible in this FIG. 1, corresponding to a plan view.

This vest 2 has, inside, a first non-inflatable zone in which the two faces opposite one another are assembled, for example by thermowelding.

The vest 2 is fixed to the harness 4 according to this non-inflatable zone.

In the variant shown in FIG. 1, the harness 4 comprises a belt 5. The lower part of the inflatable zone which takes the form of a non-inflatable frontal strip 12 according to the axis (8, 8') is fixed to this belt 5, by stitching for example. The non-inflatable frontal strip 12 can optionally have a protuberance over all or part of its length. In this case, the belt 5 of the harness 4 can be fixed, for example by stitching, to this protuberance.

As indicated earlier, this protuberance can be attached to the non-inflatable frontal strip 12, for example by stitching, themowelding or even adhesion.

It is of course also possible to envisage the presence of several distinct protuberances extending along the non-inflatable frontal strip 12, each on part of the length of this frontal strip.

In the first case, the lower part of the non-inflatable frontal strip l2 is thus fixed directly to the belt 5 of the harness 4.

In the second case, this lower part of the non-inflatable frontal strip 12 is fixed indirectly, by means of its protuberances, to the belt 5 of the harness 4.

This non-inflatable frontal strip 12 can be incurved.

Figure 2:
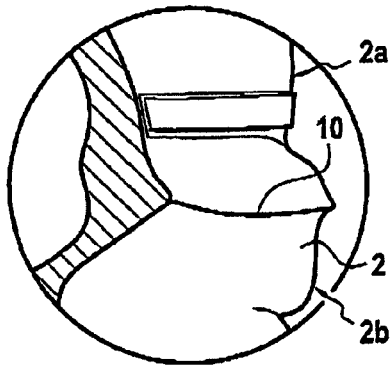

FIG. 2 schematically illustrates a detail of FIG. 1, at the level of the separation between the rear part 2*b* and the front part 2*a* of the vest 2.

In FIG. 2, the front part 2*a* and the rear part 2*b* are inverted, the view being inverted relative to the view of FIG. 1. As a consequence, the front part 2*a* at the bottom of FIG. 1 is now at the top in this FIG. 2, and the rear part 2*b* at the top in FIG. 1 is now at the bottom in this FIG. 2.

FIG. 2 therefore shows part of the front part 2*a* and of the rear part 2*b*, one of the two cotes of the vest 2, the other side being substantially identical.

In precise terms, this is the zone of the jacket 1 intended to be placed over the shoulder of the wearer. In this zone, it is important that the jacket 1 is folded to adapt to the morphology of the wearer, in passing between the front part 2*a* and the rear part 2*b* of the vest 2.

This is why this vest 2 comprises, on each side, a non-inflatable transversal strip, for example obtained by thermowelding and acting as articulation between the front part 2*a* and the rear part 2*b* of the vest 2.

This is particularly important for comfort, especially the comfort of the neck of the wearer, when the vest 2 is inflated.

Each of these non-inflatable transversal strips 10 preferably extends transversally and partially over the width of the vest 2. In this way, the air can pass from the front part 2*a* to the rear part 2*b*, by contouring the ends of these non-inflatable transversal strips 10.

These two non inflatable transversal strips 10 connect, for example by thermowelding, the two faces of the vest opposite one another, whereof one only is visible in FIG. 2.

Figure 3:
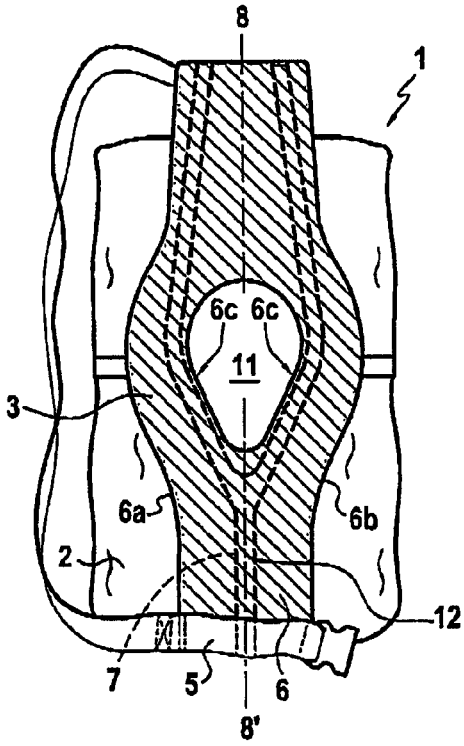

FIG. 3 schematically shows the protective envelope 3 of the vest 2 in greater detail, the latter being inflated.

The jacket 1 is provided with a first section 7 of reinforcing strap. This section 7 is connected by stitching to the belt 5, the vest 2 and the protective envelope 3. The stitching extends along the non-inflatable frontal strip which itself extends along the axis (8, B').

As mentioned earlier, the stitching can optionally extend along one or more protuberances which in turn extend along all or part of the non-inflatable frontal strip.

This single stitching or frontal stitching therefore connects the harness 4, the belt 5, the protective envelope 3 and the vest. Once the vest 2 is inflated, the whole remains tight on the wearer.

A second section of non-inflatable reinforcing strap can optionally be used, as shown in FIG. 3. This second section is thus also attached by stitching to the belt 5, the vest 2 and the protective envelope 3, along the non-inflatable frontal strip.

Here again, as mentioned earlier, the stitching of the second section can extend along one or more protuberances which in turn extend along all or part of the non-inflatable frontal strip.

These two sections, whereof section 7, or section 7 alone, extends to the rear part 2*b* of the vest 2, to pass respectively over the shoulders of the wearer.

This or these sections thus form a skeleton of stitched straps on the protective envelope 3, and assure a firm fit between the harness 4, the protective envelope 3, the vest 2, and the wearer.

As shown in this FIG. 3, the protective envelope 3 comprises a single front panel 6.

This front panel 6 has, above the belt 5, two external side edges, 6*a* and 6*b*, which arc curved and concave.

In this way, the axillary zone of the wearer is freed, benefiting mobility and arm movements. This is all the more important when the jacket 1 is worn for sailing.

As is also evident from FIG. 3, the vest 2 has an oblong configuration with a hole 11 offset to the rear part 2*b*, to benefit passage 11 of the head of the wearer.

This ensemble form of the vest 2 further limits the risks of obstruction of airways of the wearer when this vest 2 is inflated.

This hole 11 is also delimited by the internal lateral edge 6*c* of the front panel 6 of the protective envelope 3, forming the circumference.

The contour of this hole 11, once the jacket is being worn, therefore starts according to a rounded form around the xiphoid appendix of the wearer, therefore in the front part, extends to the rear part near the centre of the right trapezius muscle of the wearer by contouring his sternum to the right, passes to the rear of the neck of the wearer, returns to the front part near the left trapezius muscle then rejoins the xiphoid appendix by contouring the sternum to the left.

Figure 4:
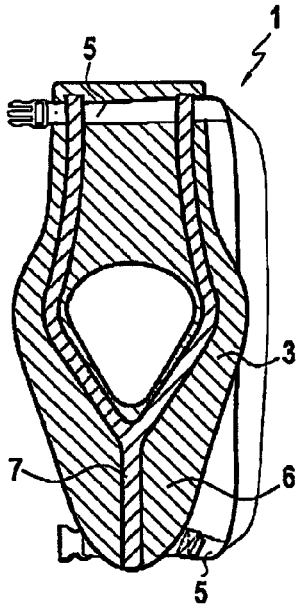

FIG. 4 schematically illustrates the jacket 1 in bottom plan view, with the vest 2 deflated and folded inside the protective envelope 3, the latter being closed such that the vest 2 cannot escape via the peripheral opening 3*a* shown earlier relative to FIG. 1.

The other elements referenced in FIG. 4 are identical to those shown relatively in the preceding figures and are therefore not repeated here in detail.

The entirety of the above description is given by way of example and is does not limit the invention.

This is the case in particular of the form exact of the different elements of the jacket 1 of the invention.

The invention claimed is:

1. A lifejacket, comprising:

an inflatable vest having two faces opposite one another;

a protective envelope in which said vest is housed in a folded state and which comprises an external peripheral opening fitted with temporary closing means by which said vest expands when inflated, and a carrying harness to which said protective envelope is fixed, wherein said vest comprises a non-inflatable frontal strip therein, in which said two faces of the vest opposite one another are assembled, wherein said vest is fixed to said carrying harness, wherein the carrying harness comprises a belt in which a lower part of the non-inflatable frontal strip is directly connected to said belt.

2. The life jacket as claimed in claim 1, wherein the two faces of the vest opposite one another are assembled by thermowelding.

3. The lifejacket as claimed in claim 1, further comprising at least a first section of reinforcing strap, connected by stitching to the belt, the vest and the protective envelope.

4. The lifejacket as claimed in claim 3, further comprising a second section of reinforcing strap, connected by stitching to the belt, the vest and the protective envelope, the first section and said second section extending to the rear part of the vest so as to respectively pass over the two shoulders of the wearer.

5. The lifejacket as claimed in claim 1, wherein the protective envelope comprises a single frontal panel whereof two side edges, above the belt, have concave curves.

6. The lifejacket as claimed in claim 1, wherein the vest comprises two transversal non-inflatable strips arranged above the shoulders of the wearer and suitable for acting as articulations between front and rear parts of the vest.

7. The lifejacket as claimed in claim 6, wherein each transversal non-inflatable strip occupies only part of the width of the vest, so as to allow the passage of air between the front and rear parts of the vest.

8. The lifejacket as claimed in claim 1, wherein the vest has an oblong configuration with a hole offset to a rear for passage of a user's head.

* * * * *